US005909893A

United States Patent [19]

Keller et al.

[11] Patent Number: 5,909,893

[45] Date of Patent: Jun. 8, 1999

[54] RETAINING APPARATUS FOR SECURING BINDINGS ON SNOWBOARDS OR THE LIKE

[75] Inventors: Alexander Keller, Unterammergau; Edwin Lehner, Farchant, both of Germany

[73] Assignee: Marker Deutschland GmbH, Eschenlohe, Germany

[21] Appl. No.: 08/792,883

[22] Filed: Jan. 31, 1997

[30] Foreign Application Priority Data

Feb. 2, 1996 [DE] Germany ..... 196 03 522

[51] Int. Cl.[6] ..... A63C 9/00

[52] U.S. Cl. ..... 280/607; 280/617; 280/14.2

[58] Field of Search ..... 280/607, 620, 280/618, 14.2, 617, 633, 634

[56] References Cited

U.S. PATENT DOCUMENTS

| | | | |
|---|---|---|---|
| 5,054,807 | 10/1991 | Fauvet | 280/607 |
| 5,156,644 | 10/1992 | Koehler et al. | 280/14.2 |
| 5,172,924 | 12/1992 | Barci | 280/14.2 |
| 5,190,311 | 3/1993 | Carpenter et al. | 280/618 |
| 5,236,216 | 8/1993 | Ratzek | 280/607 |
| 5,261,689 | 11/1993 | Carpenter et al. | 280/618 |
| 5,354,088 | 10/1994 | Vetter et al. | 280/618 |
| 5,356,170 | 10/1994 | Carpenter et al. | 280/618 |
| 5,499,837 | 3/1996 | Hale et al. | 280/607 |
| 5,505,478 | 4/1996 | Napoliello | 280/618 |
| 5,577,755 | 11/1996 | Metzger et al. | 280/607 |
| 5,586,779 | 12/1996 | Dawes et al. | 280/14.2 |
| 5,649,722 | 7/1997 | Champlin | 280/818 |
| 5,765,853 | 6/1998 | Erb | 280/607 |
| 5,791,678 | 8/1998 | Perlman | 280/618 |

FOREIGN PATENT DOCUMENTS

| | | | |
|---|---|---|---|
| 1307982 | 9/1961 | France . | |
| 26 624 389 | 12/1987 | France | A63C 13/00 |
| 91 08 513 U1 | 11/1991 | Germany | A63C 9/02 |
| WO95/19205 | 7/1995 | WIPO | A63C 9/08 |

*Primary Examiner*—Lanna Mai
*Assistant Examiner*—Bridget Avery
*Attorney, Agent, or Firm*—D. Peter Hochberg

[57] ABSTRACT

A pattern of holes is provided for a retaining part for securing bindings on snowboards and the like, for receiving fastening screws and for enabling a two-dimensional adjustment of the retaining part and of the binding, relative to fastening points on the snowboard or the like.

11 Claims, 5 Drawing Sheets

RETAINING APPARATUS FOR SECURING BINDINGS ON SNOWBOARDS OR THE LIKE

BACKGROUND OF THE INVENTION

1. Field of the Invention

The invention relates to a retaining part, in particular a fastening plate, for securing bindings on snowboards or the like. The invention specifically pertains to retaining parts having holes intended for receiving fasteners such as fastening screws which can be screwed into predetermined or predeterminable mounts such as screw mounts on the snowboard or the like. The fasteners brace or hold the retaining part on the snowboard or the like. The holes form a pattern wherein the retaining pat can be fixed on the snowboard or the like in different positions relative to the mounts.

2. Description of the Prior Art

Conventional bindings for snowboards or the like typically have a base plate which rests on the upper side of the snowboard, and have a large central circular opening and a circumferential border provided with an end-side toothing arrangement. An essentially circular fastening plate fits into said circular opening, and can be secured by screws to the snowboard, with the base plate of the snowboard binding being braced in a frictionally locking manner between a circular border region of the fastening plate and the upper side of the snowboard. The base plate is additionally fixed in a positive locking manner by the end-side toothing arrangement on the circular opening of the base plate engaging into an end-side mating toothing arrangement on the circumferential border of the fastening plate. In this manner, it is possible to fasten the base plate, and thus also the snowboard binding, in principle in any rotary position relative to a vertical axis of the snowboard.

It is already known in principle, for the purpose of receiving the fastening screws, to provide rows of holes on the fastening plate such that, with the correspondingly modified arrangement of the screws, the fastening plate can be adjusted in the longitudinal direction of the snowboard. Accordingly, therefore, the snowboard binding can be mounted in different positions relative to the screw mounts in the direction of the longitudinal axis of the snowboard.

SUMMARY OF THE INVENTION

An object of the present invention is to provide new adjustment arrangements for bindings on snowboards and the like.

Another object of the invention is to provide a fastening plate for securing bindings to snowboards or the like in which the fastening plate can be adjusted in two dimensions.

It is another object of the present invention to provide a retaining part, such as a fastener plate, for snowboards or the like, which can be adjusted in two dimensions perpendicular to each other in an easy and practical manner.

Other objects will become apparent from the description to follow and from the appended claims.

These objects are achieved according to the preferred embodiment of the invention by the provision of a pattern of holes in a retaining plate such as a fastening plate for snowboards or the like, to enable a two-dimensional adjustment of the retaining part in two mutually-perpendicular directions which are approximately parallel to the upper side of the snowboard or the like.

The preferred embodiment of the invention not only enables an adjustment of the bindings in the longitudinal direction of the snowboard or the like, but also enables an adjustment in the transverse direction thereof, so that it is possible to coordinate the transmission of forces and torques between the feet or legs of the snowboarder and the snowboard in a particularly versatile manner. This takes into account the fact that the snowboarder typically stands on the snowboard essentially transversely to the longitudinal axis of the same and, accordingly, has to control the use of one longitudinal edge of the snowboard with the heels and the use of the other longitudinal edge of the snowboard with the toes. The capacity for adjusting the bindings in the transverse direction of the snowboard means that particular account can be taken of the differing forces in the heel area and toe area of the feet of the snowboarder in question.

BRIEF DESCRIPTION OF THE DRAWINGS

In addition, as regards preferred features of the invention, reference is made to the claims and to the following explanation of the drawings, with reference to which particular preferred embodiments are described, and in which:

DESCRIPTION OF THE PREFERRED EMBODIMENTS

Figure 1:
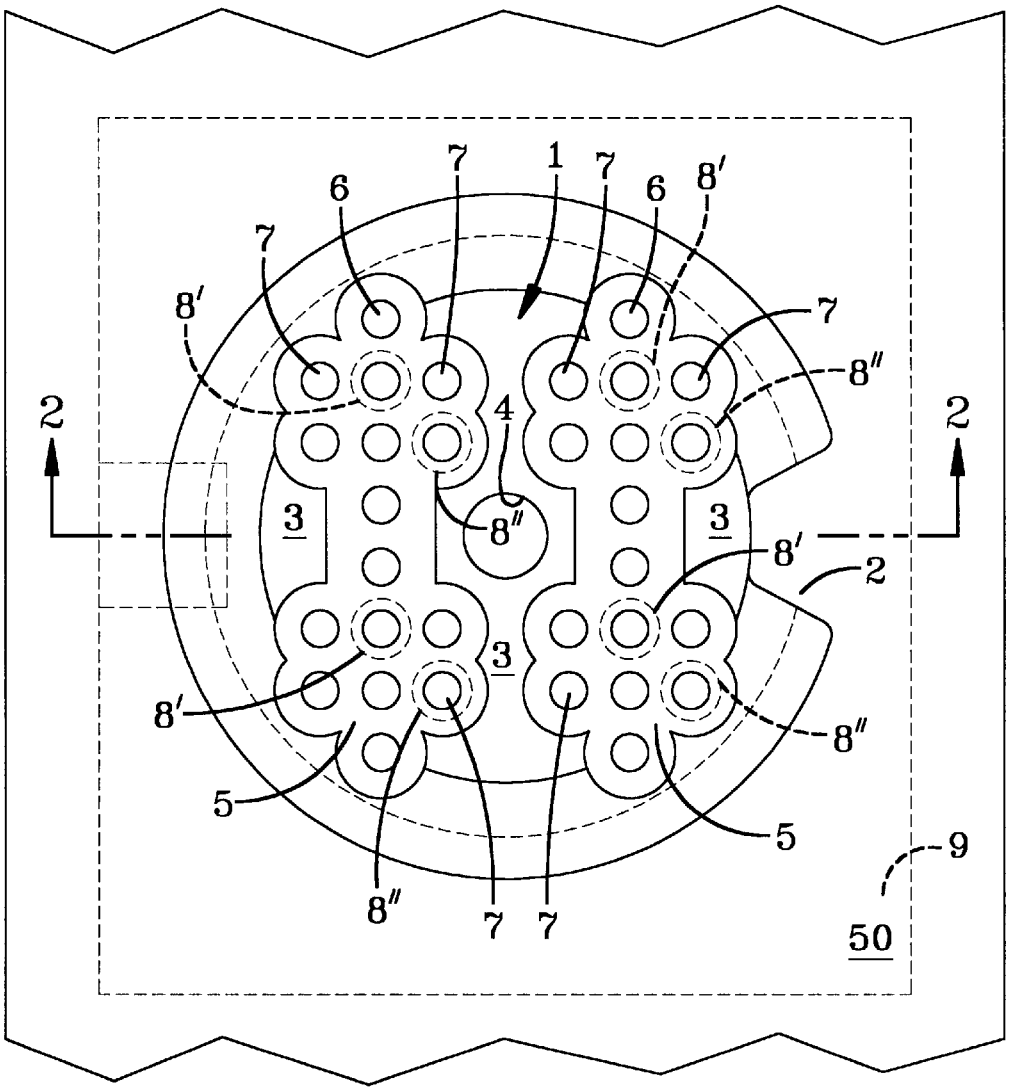
FIG. 1 shows a plan view of a first embodiment of a fastening plate.
Figure 2:
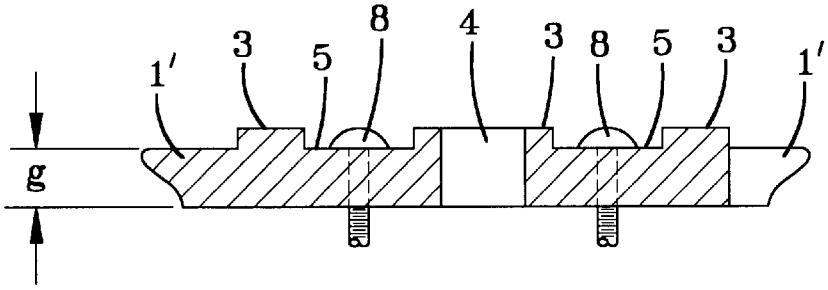
FIG. 2 shows a sectional view of this plate along section line II in FIG. 1.

In the example of FIGS. 1 and 2, the fastening plate 1 illustrated is essentially in the form of a disk. The disk preferably has at least one recess 2 on the circumference of the plate in order for it to be possible to insert the fastening plate 1 into a correspondingly circular opening of a base plate of a snowboard binding even when part of the contour of the binding protrudes above the base plate. The circumferential border of the fastening plate 1 is of undercut design so as to form a border region 1' which is vertically spaced apart from the plane of the underside of the fastening plate and has an end-side toothing arrangement on its underside.

Arranged on the upper side of the fastening plate 1, within an inner circular region concentric to the border region 1', are zones 3 which are elevated with respect to the border region 1' and may serve as a tread or standing surface for a boot which has been inserted into the snowboard binding.

A central bore 4 of relatively large diameter may be provided in the center of the fastening plate 1.

Furthermore, two large surface-area depressions 5, which are located diametrically opposite one another with respect to the center of the plate, are arranged on the upper side of the fastening plate 1 and, in tile plan view of FIG. 1, are each of a shape similar to the side view of a dumbbell. The upper side of these depressions 5 is located a little way beneath, as seen in the vertical direction, the upper side of the border region 1' and of the annular zone which adjoins said border region towards the inside in the radial direction and into which the depressions 5 extend a short distance.

Two mutually parallel, long rows of holes 6 are arranged within the depressions 5. Arranged on both sides of each of these rows of holes 6 are in each case two shorter rows of holes 7 which are parallel to the rows of holes 6, spaced apart from one another in the transverse direction and beyond the mutually remote ends of which the respectively adjacent row of holes 6 projects in the longitudinal direction. In this case, the rows of holes 7 are arranged besides the respectively adjacent row of holes 6 such that there are shorter rows of holes extending transversely to the respective row of holes 6.

The round holes of the rows of holes 6 and 7 serve to receive fastening screws 8 which can be screwed into threaded bores of screw mounts on the snowboard 50, the operation of tightening the screws 8 causing the border region 1' of the fastening plate 1 to engage, by means of the end-side toothing arrangement on its underside, into a mating toothing arrangement on the circumferential border of a circular opening of a snowboard binding base plate 9, which is only indicated in FIG. 2, and the base plate 9 to be clamped in firmly between the border region 1' and the upper side of the snowboard.

The above-mentioned screw mounts on the snowboard are arranged at the corner points of a square (indicated by dots in FIG. 1). The holes of the rows of holes 6 and 7, then, are arranged relative to one another such that the fastening plate 1 can be mounted in a variety of offset positions relative to the screw mounts. Two possible arrangements of the fastening screws 8 within the fastening plate 1 are marked by 8' and 8" in FIG. 1. On the one hand, it is possible to have arrangements in which the screws 8 are each provided in holes of the long rows of holes 6. On the other hand, it is possible to have arrangements in which the screws 8 are each provided in the short rows of holes 7, either to the right or left of the rows of holes 6 in the illustration of FIG. 1.

Since the screw mounts, and thus also the fastening screws inserted therein, in each case form a square, it is also possible for the fastening plate 1 to be mounted such that it has been rotated through 90° or a multiple of 90° with respect to the position illustrated in FIG. 1, as a result of which the possible variations of snowboard binding positions which can be produced are increased in a corresponding manner.

If appropriate, a marking provided on the snowboard may be identified through the central bore 4, so that it can be established whether the fastening plate 1 is centered in the desired manner.

Figure 3:
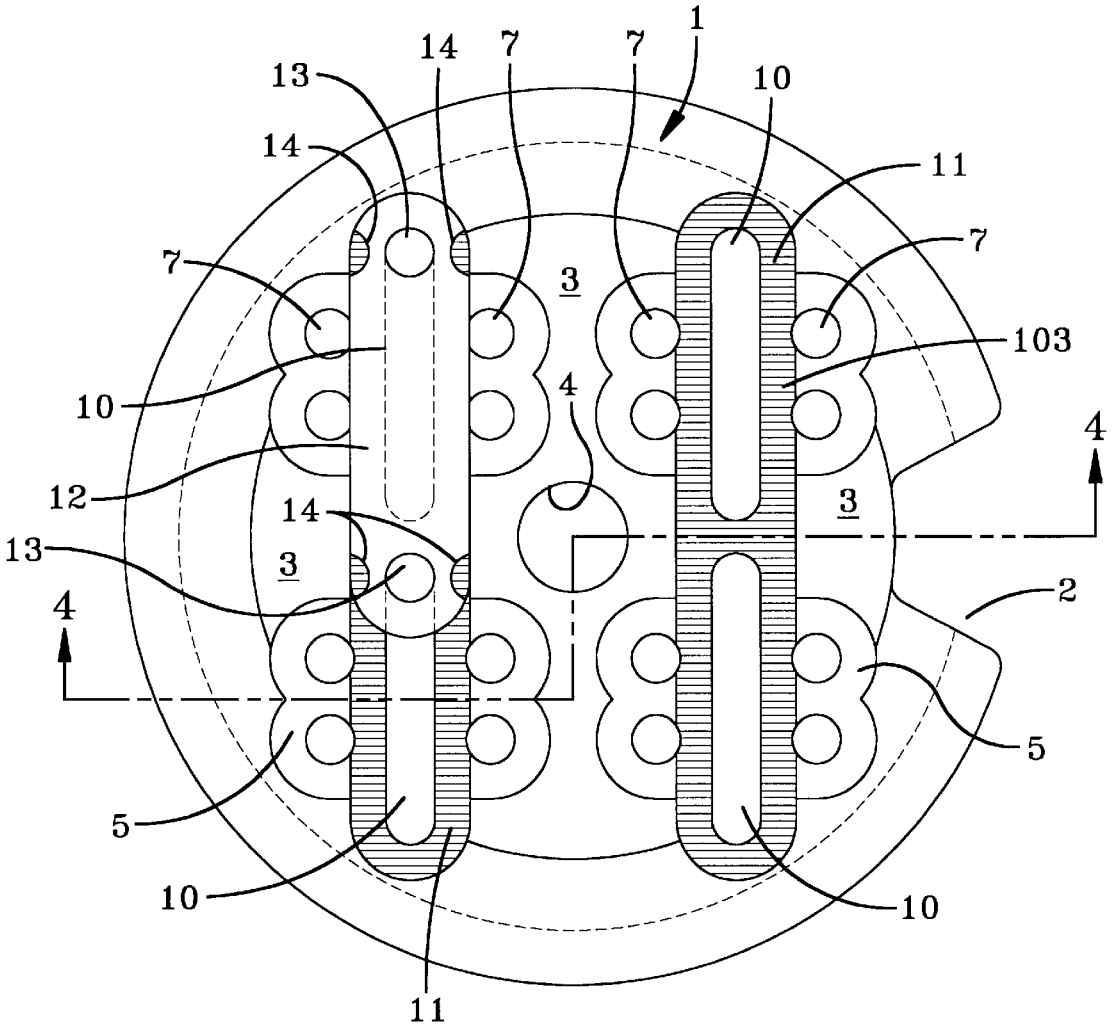
FIG. 3 shows a plan view, corresponding to FIG. 1, of a modified embodiment.
Figure 4:
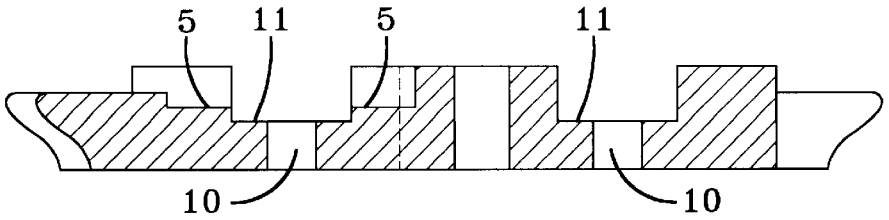
FIG. 4 shows a sectional view along the section line IV—IV in FIG. 3.

The embodiment of FIGS. 3 and 4 differs from the embodiment of FIGS. 1 and 2 in particular in that each row of holes 6 formed by round holes are each replaced by two elongate holes or slots 10. The surrounding zones 11 of the elongate holes 10 are arranged in a somewhat sunken manner with respect to the remaining base of the depressions 5 and are provided with a ribbing arrangement 103 which runs transversely to the longitudinal axis of the elongate holes 10. The sunken surrounding zones 11, which extend to the side of the elongate holes 10 as far as the region of a circumferential section of the holes of the adjacent rows of holes 7, form a guide for flat strips 12 which are each provided, at their ends, with round holes 13 and, in the surrounding zone of these round holes 13, with an underside ribbing arrangement which can engage into the ribbing arrangement of the surrounding zones 11.

The spacing between the round holes 13 of the flat strips 12 corresponds in each case to that between the threaded bores of the screw mounts on the snowboard.

The fastening plate 1 may thus be fastened on the snowboard with the screws 8 inserted into the holes 13 of the flat strips 12, which are received next to each other in the surrounding zones 11 of the elongate holes 10 such that the holes 13 form a square. Before the fastening screws 8 are screwed firmly into the screw mounts of the snowboard, it is possible to displace the fastening plate 1 (with the base plate 9 of the snowboard binding) into a desired position in the longitudinal direction of the flat strips 12. Once the screws 8 have been tightened, the fastening plate 1 is braced or held firmly between the flat strips 12, the border of the base plate 9 of the snowboard binding and the upper side of the snowboard. The position of the fastening plate in the longitudinal direction of the flat strips 12 is also secured in a positive locking manner by mutual engagement of the ribbing arrangements of the flat strips 12 and of the surrounding zones 11 one into the other, while, in the sidewards direction of the flat strips 12, there is a positive locking connection between the longitudinal borders thereof and the step-like transition between the surrounding zones 11 and the elevated zones 3 and/or the adjoining base of the depressions 5. The ribbing arrangements are designed such that the ribs are spaced apart at close intervals, so that very closely adjacent positions of the fastening plate 1 can be set.

The longitudinal sides of the flat strips 12 each have, besides the holes 13, recesses 14 which are in the form of arcs of a circle and, in plan view, match the corresponding circumferential regions of the holes of the rows of holes 7 as soon as the flat strips 12 are positioned such that their holes 13 form, with adjacent holes of the rows of holes 7, rectilinear rows of holes which extend in each case transversely to the elongate holes 10. Since the thickness of the flat strips 12 is such that the upper side of said flat strips is located in the same plane as the base of the depressions 5 when the flat strips have been inserted into the surrounding zones 11, the underside of the screw head of a screw 8 which has been inserted, beside a recess 14, into a hole of the rows of holes 7 is supported uniformly on the base of the respective depression 5 and on the border of the respective flat strip 12. In addition, the screw shank projects some way into the respective recess 14, with the result that the fastening screws 8 can only be inserted into holes of the rows of holes 7 besides the flat strips 12 when the flat strips 12 assume, with their recesses 14, a position directly beside the respective screw shanks.

As soon as the holes of the rows of holes 7 are used for receiving the fastening screws 8, it is possible to have the same positions for the fastening plate 1 of FIG. 3 as for the fastening plate 1 of FIG. 1. If, in contrast, the fastening screws 8 are inserted into the holes 13 of the flat strips 12, then, depending on the position of the flat strips 12 in the surrounding zones 11, it is possible to obtain, n the one hand, those positions which are obtained in the case of the fastening late 1 of FIG. 1 by using the holes of the rows of holes 6 for the screws 8 and also, on the other hand, any positions in between.

Figure 6:
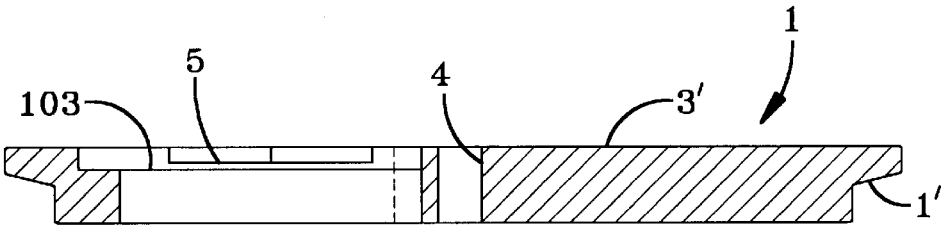
FIG. 6 shows a sectional view taken along the section line VI—VI in FIG. 5.
Figure 5:
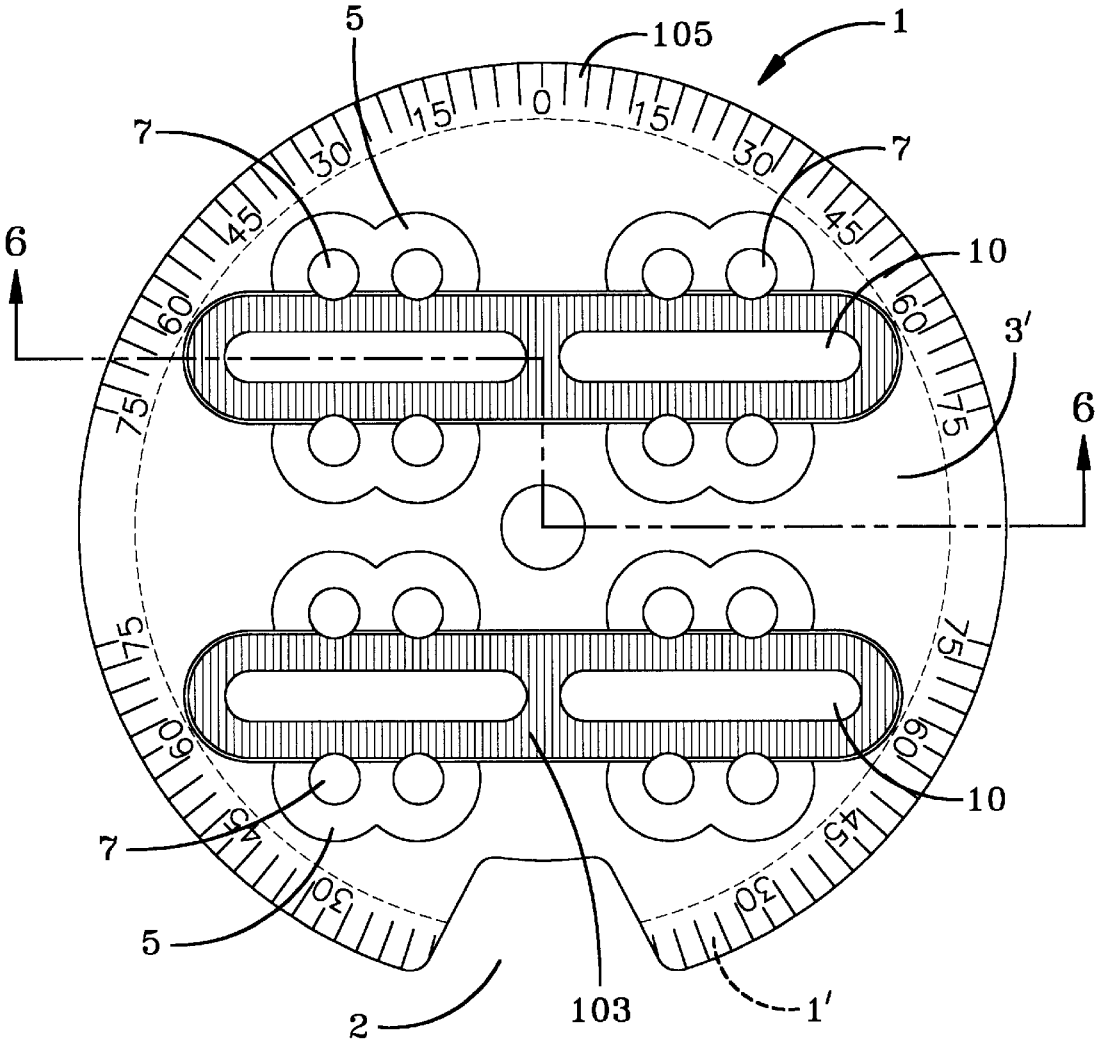
FIG. 5 shows a plan view of a modified embodiment of the invention.

FIGS. 5 and 6 show an embodiment very similar to the embodiment of FIGS. 3 and 4, and like components have like numbers. The fastening plate 1' has an area 3' for supporting the snowboarder's boot. The recessed area with the transverse ribbing 103, having elongated slots 10, is shown. Holes 7 are provided in depressed areas 5. The central hole 4 is shown. A set of graduated angular markings 105 is provided for indicating to the snowboarder the position of the fastener plate. The undercut region 1' is also shown.

Figure 8:
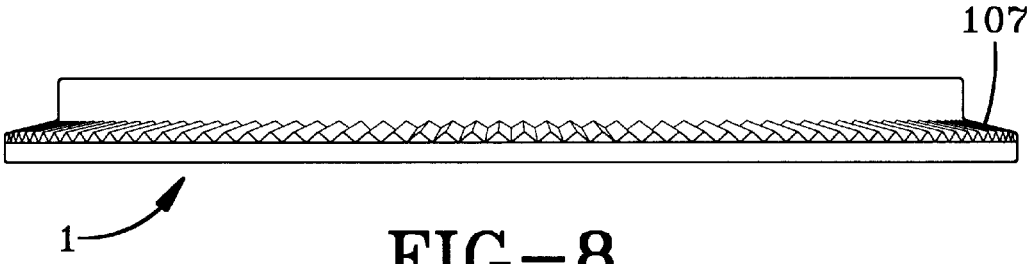
FIG. 8 is a side view of the embodiment shown in FIG. 7.
Figure 7:
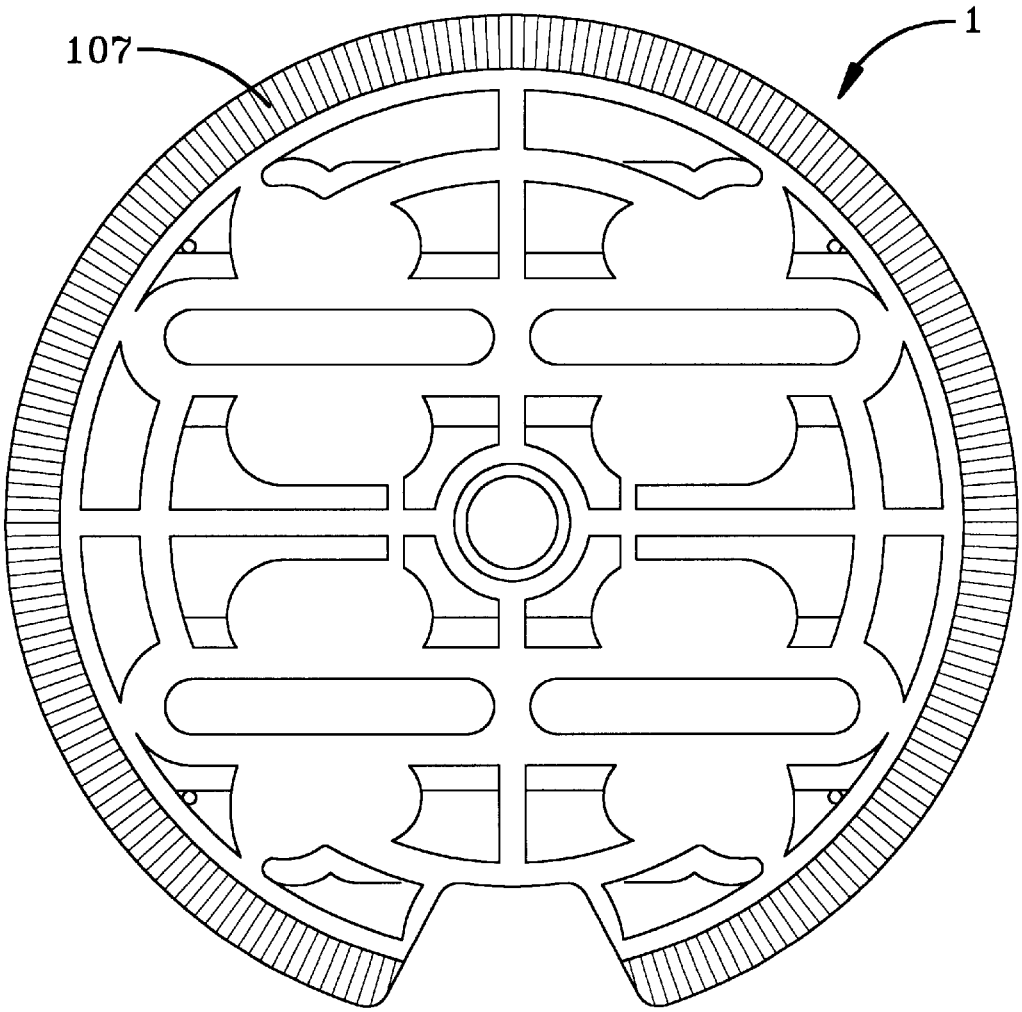
FIG. 7 shows a bottom plan view of the embodiment shown in FIG. 5.

FIGS. 7 and 8 show a bottom and side view of the fastening plate 1 of FIGS. 5 and 6 without the holes and elevated and depressed areas being shown. Teeth 107, which engage corresponding teeth on the base plate, are shown.

Figure 9:
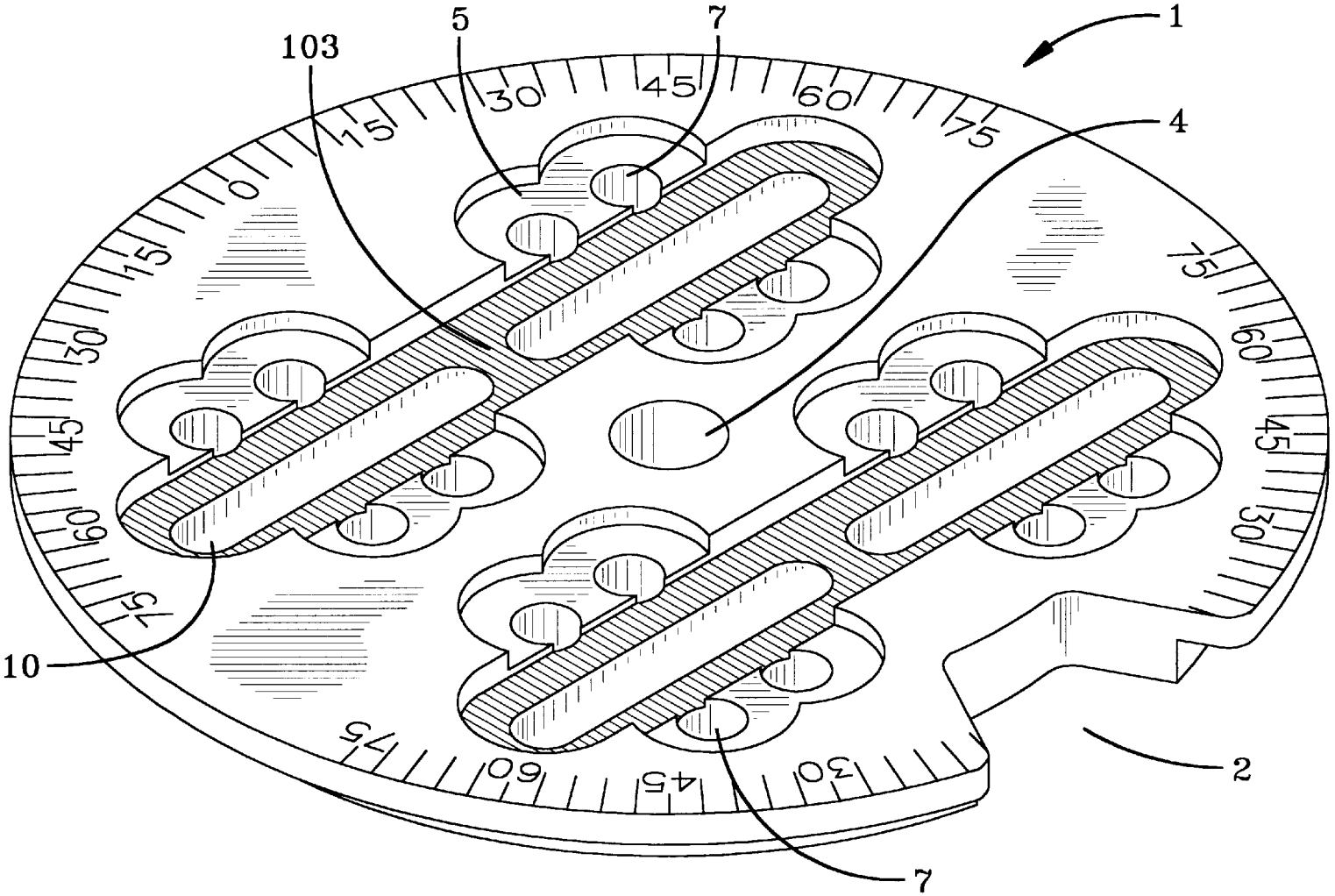
FIG. 9 is a perspective view of the embodiment shown in FIGS. 5–8.

FIG. 9 depicts the fastening plate 1 of FIGS. 5–8 in perspective. Plate 1 has holes 7 which are surrounded by depressed areas 5. Elongated holes 10 are surrounded by ribbed, depressed areas 103. Flat strips 12 are not shown.

The embodiments of the invention can all be made using ordinary plastic fabricating techniques. They enable a great variety of positions in which the retaining part can be positioned on a snowboard or the like, in two-dimensional perpendicular directions. This can be done using only four mounts set in a square relationship on the snowboard.

The invention has been described in detail, with particular emphasis being placed on the preferred embodiments thereof, but variations and modifications within the spirit and scope of the invention may occur to those skilled in the art to which the invention pertains.

What is claimed is:

1. A retaining part for securing bindings on snowboards, having holes for receiving fasteners to be inserted into predetermined mounts on the snowboard, for holding said retaining part on the snowboard, said holes forming such a pattern for fixing said retaining part on the snowboard in different positions relative to the mounts, said pattern of holes having at least one long row of holes, and parallel, shorter rows of holes arranged beside said long row of holes, wherein the pattern of holes enables a two-dimensional adjustment of said retaining part in two mutually perpendicular directions which are approximately parallel to the upper side of the snowboard.

2. The retaining part as claimed in claim 1, wherein said retaining part comprises a circular fastening plate to be received by a corresponding circular opening in a base part of the binding, said binding being braceable on the snowboard in different rotary positions with respect to the circle axis of the circular opening.

3. The retaining part as claimed in claim 1, wherein said pattern of holes comprises at least a pair of parallel, long elongate holes or at least one long row of long elongate holes and shorter rows of smaller holes arranged beside said elongate holes.

4. The retaining part as claimed in claim 3, and further comprising flat strips with holes for overlapping said elongate holes, said holes receiving fasteners for extending through said elongate holes to fasten said retaining part to the snowboard, and zones around said elongated holes on that side of the retaining part directed away from the snowboard, said zones being sunken with respect to surrounding regions of the shorter rows of holes to form a guiding bed for the translatory guidance of said flat strips.

5. The retaining part as claimed in claim 4, wherein the surrounding 30 zones of said elongate holes comprise a ribbing arrangement transverse to the longitudinal axis of said elongate holes, and wherein said flat strips comprise a corresponding ribbing arrangement, the ribbing arrangements engaging each other in a positively locking manner.

6. The retaining part as claimed in claim 4, wherein the holes of the shorter rows of holes project into the sunken surrounding zones by means of circumferential sections, and wherein said flat strips overlap the holes in the shorter rows of holes when said holes in said strip overlap elongated hole(s) and said strips include recesses in the form of arcs of a circle corresponding in size to the size of a hole in the shorter rows of holes, said recesses receiving fasteners inserted into the hole in a shorter row of holes to fasten said flat strip with said retaining part to a snowboard.

7. The retaining part as claimed in claim 6, and further comprising elevated zones near but spaced from said holes in said retaining part, a depressed section having a depressed planar surface at least partially surrounding said zones around said elongated holes, and wherein said flat strip has a thickness to enable said flat strip to be inserted into said zone around said elongated hole, with the upper side being located in the same plane as the depressed planar surface of said depressed section.

8. The retaining part as claimed in claim 1, and further comprising means for identifying a marking on the snowboard.

9. The retaining part according to claim 8, wherein said means for identifying a marking comprises a central bore.

10. The retaining part according to claim 5 wherein said ribbing arrangements comprise a fine ribbing arrangement to enable finely spaced adjustments.

11. A retaining part for securing boot bindings by means of fasteners on a snowboard having a plurality of mounts in predetermined positions for receiving fasteners, said retaining part comprising: a fastening plate having orthogonal rows of parallel holes for receiving the fasteners, wherein holes from said orthogonal rows being alignable with the mounts in the snowboard to enable the fastening of said fastening plate to the snowboard in different positions on the snowboard, depending on the alignment of the holes in said fastening plate with the mounts in the snowboard.

* * * * *